US006647366B2

(12) United States Patent
Wang et al.

(10) Patent No.: US 6,647,366 B2
(45) Date of Patent: Nov. 11, 2003

(54) RATE CONTROL STRATEGIES FOR SPEECH AND MUSIC CODING

(75) Inventors: Tian Wang, Goleta, CA (US); Kazuhito Koishida, Goleta, CA (US); Vladimir Cuperman, Goleta, CA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 10/032,642

(22) Filed: Dec. 28, 2001

(65) Prior Publication Data

US 2003/0125932 A1 Jul. 3, 2003

(51) Int. Cl.[7] ..... G10L 19/00; G10L 19/02

(52) U.S. Cl. ..... 704/201; 704/211

(58) Field of Search ..... 705/17; 704/278, 704/270.1, 270, 267, 265, 262, 260, 258, 230, 231, 229, 223, 221, 220, 219, 217, 216, 214, 211, 207, 206, 201; 375/244, 225

(56) References Cited

U.S. PATENT DOCUMENTS

| | | | | | |
|---|---|---|---|---|---|
| 5,717,823 | A | * | 2/1998 | Kleijn | 110/235 |
| 5,734,789 | A | * | 3/1998 | Swaminathan et al. | 704/206 |
| 5,751,903 | A | * | 5/1998 | Swaminathan et al. | 704/219 |
| 5,778,335 | A | | 7/1998 | Ubale et al. | |
| 6,108,626 | A | * | 8/2000 | Cellario et al. | 704/205 |
| 6,134,518 | A | * | 10/2000 | Cohen et al. | 704/201 |
| 6,240,387 | B1 | * | 5/2001 | DeJaco | 704/219 |
| 6,310,915 | B1 | * | 10/2001 | Wells et al. | 375/240.03 |
| 6,311,154 | B1 | * | 10/2001 | Gersho et al. | 375/240.03 |
| 2001/0023395 | A1 | * | 9/2001 | Su et al. | 704/220 |

FOREIGN PATENT DOCUMENTS

WO WO 9827543 6/1998

OTHER PUBLICATIONS

Ramprashad, "A multimode tramsform predictive coder (MTPC) for speech and audio," in Speech Coding Proceedings, 1999 IEEE Workshop on, pp. 10–12, Jun. 20–23, 1999. Porvoo, Finland. □□*

Bessette et al., "A Wideband Speech and Audio Codec At 16/24/32 kbit/s Using Hybrid ACELP.TCX Techniques," *In Proceedings of IEEE Workshop on Speech Coding*, pp. 7–9, Porvoo, Finland (Jun. 1999).

Combescure, P., et al., "A 16, 24, 32 kbit/s Wideband Speech Codec Based On ATCELP," *In Proceedings of IEEE International Conference on Acoustics, Speech, and Signal Processing*, vol. 1, pp. 5–8, (Mar. 1999).

Ellis, D., et al., "Speech/Music Discrimination Based On Posterior Probability Features," *In Proceedings of Eurospeech*, 4 pages, Budapest (1999).

El Maleh, K. et al., "Speech/Music Discrimination For Multimedia Applications," *In Proceedings of IEEE International Conference on Acoustics, Speech, and Signaling Processing*, vol. 4, pp. 2445–2448 (Jun. 2000).

Saunders, J., "Real–Time Discrimination Of Broadcast Speech/Music," *In Proceedings of IEEE International Conference on Acoustics, Speech, and Signal Processing*, vol. 2, pp. 993–996 (May 1996).

(List continued on next page.)

*Primary Examiner*—Marsha D. Banks-Harold
*Assistant Examiner*—V. Paul Harper
(74) *Attorney, Agent, or Firm*—Leydig, Voit & Mayer, Ltd.

(57) ABSTRACT

A method and a system are provided for controlling the coding rates of a multimode coding system with respect to a sequence of input audio signal frames. The method eliminates or minimizes the overflow and underflow of a bit-stream buffer maintained by the coding system for temporarily recording bit-stream data prior to transmission or storage.

25 Claims, 6 Drawing Sheets

OTHER PUBLICATIONS

Scheirer, E., et al., Construction and Evaluation of a Robust Multifeature Speech/Music Discriminator, *In Proceedings of International Conference on Acoustics, Speech, and Signal Processing*, vol. 2, pp. 1331–1334 (Apr. 1997).

Tancerel, L., et al., "Combined Speech and Audio Coding By Discrimination," *IEEE Workshop on Speech Coding*, pp. 154–156 (Sep. 2000).

Houtgast, T., et al., "The Modulation transfer Function In Room Acoustics As A Predictor of Speech Intelligibility," *Acustica*, vol. 23, pp. 66–73 (1973).

Tzanetakis, G., et al., "Multifeature Audio Segmentation for Browsing and Annotation," *IEEE Workshop on Application of Signal Processing to Audio and Acoustics*, New Paltz, NY, pp. 103–103 (Oct. 1999).

Schnitzler, J., et al., "Wideband Speech Coding Using Forward/Backward Adaptive Prediction and Mixed Time/Frequency Domain Excitation," *In IEEE Workshop on Speech Coding Proceedings*, pp. 3–5 (Jun. 1999).

Chen, J–H, et al., "Transform Predictive Coding of Wideband Speech Signals," In Proc. International Conference on Acoustic, Speech, and Signal Processing, pp. 275–278 (1996).

Ubale, A., et al., "A Multi–Band Celp Wideband Speech Coder," In Proc. *IEEE International Conference on Acoustics, Speech, and Signal Processing*, vol 2, Munich, Germany (Apr. 1997).

* cited by examiner

RATE CONTROL STRATEGIES FOR SPEECH AND MUSIC CODING

FIELD OF THE INVENTION

This invention is related, in general, to the art of coding digital signals, and more particularly, to a method and a system of controlling coding modes of multimode coding systems for coding speech and music signals.

BACKGROUND OF THE INVENTION

In current multimedia applications, audio data streams carry both speech and music signals. Even within a signal type, there are distinct categories of signals. For example, during certain types of speech, the audio signal exhibits a highly periodic signal structure. This type of signal is called voiced signal. On the other hand, a speech signal may exhibit a random structure. Such a signal lacks periodic structure, or pitch, and is termed an unvoiced signal. At certain points in a speech signal, the signal may show only continuous background noise or silence. Such a signal is termed a silence signal. In addition to the above types of speech signals, there also exist transition regions in a typical speech signal wherein the signal is changing from one type, such as unvoiced, to another, such as voiced. In such a region, the signal typically demonstrates one or more large signal spikes on top of a background signal.

Humans have a finite perceptual capability with respect to audio signals, and errors or noise in signals of different types may be perceived more or less strongly depending upon the base signal type. This is true not only for speech signals but also for other audio signal types such as music signals.

Some current coding technologies enable a coding system to code audio signals with different modes, for example, speech mode for coding speech signals and music mode for coding music signals. In the coding of audio signals, input signals are typically first digitized into signal samples, and the signal samples are grouped into signal frames. Before actual coding of a frame begins, the frame may be analyzed. Thereafter, the frame is encoded into a bit-stream using the appropriate coding mode, wherein a number of coding bits are allocated for coding of the signals in each frame. The coded bit-streams are transmitted, such as via a network, to a remote coding system, which converts the bit-streams back into audio signals. Alternatively, the coded signal may be stored. Whether the signal is to be transmitted or stored, the coding process typically is adapted to attempt to minimize the amount of data used to effectively code the signal, thus minimizing the required transmission bandwidth or storage space.

For the most part, multimode coding systems employ fixed rate coding techniques. Such coding systems are inefficient in that they do not take advantage of the finite human perceptual capability to allocate the usable data capacity. More recently, variable-rate coding strategies have received intensive study and some of these strategies provide gains over the fixed rate methods.

A typical variable-rate coding technique takes advantage of the nature of human aural perception by using a minimum number of bits to code the signal without substantially impacting the perceptual quality of the reconstructed audio signal. In this way, high perceptual quality is achieved while using a minimum number of bits.

Most existing variable-rate coding systems are optimized for short end-to-end delay, such as may be required in many real-time applications. However, there are delay-insensitive applications such as Internet streaming, books on tapes, etc. Existing coding mechanisms used for these applications do not take advantage of the longer permissible delay, and as such do not minimize the average coding rate to the greatest extent possible.

SUMMARY OF THE INVENTION

The present invention provides a method and a system for use in a multimode coding system for minimizing the amount of data needed to transmit and/or store a coded representation of an audio signal. The coding technique employed to encode an interval of an audio signal is selected according to the characteristics of the current audio frame, as well as the statistical characteristics of a current sequence of audio frames, as well as the status of a bit-stream buffer provided for buffering the encoded bit-stream. A coding delay is effectively utilized to optimally allocate available average transmission or storage capacity for a sequence of frames, so that more capacity is available when needed for signals of higher complexity, while less capacity is utilized to code signal intervals that are perceptually less significant.

In an embodiment of the invention, a set of audio signal classes are defined based on possible intrinsic characteristics of the input audio signals. Each of the classes is then associated with an expected coding rate according to the relative importance of the signals of that class to the perceptual quality of the audio signals. The available coding rates will be based on a required average coding rate that is related to the configuration of the coding system and the environment that the coding system is operated in. Thus, audio signals of a particular class are expected to be coded at a particular coding rate associated with the particular class.

A sequence of input audio signal samples are queued in a look-ahead buffer as a sequence of audio frames, each frame consisting of a number of audio signal samples. Based on statistical characteristics of the audio signals therein, each frame is classified into one of the defined classes. The classified frames are then sequentially encoded by a multimode encoder, with each frame being encoded at a rate that is as close as possible to a target coding rate. The target coding rate is obtained by adjusting the expected coding rate, wherein the amount of the adjustment is determined with respect to the sequence of frames and the status of the bit-stream buffer. In determining the target coding rate, issues of overflow and underflow of the bit-stream buffer are addressed. Those of skill in the art will appreciate the correspondence between bits and bits per second, or "rate." Accordingly, when the terms "bit(s)" and "rate(s)" are employed herein, those of skill in the art will appreciate that they may easily convert from one to the other by accounting for the time over which the bits are processed or transmitted as the case may be.

In a first example, a sequence of speech signals is received in a time interval, and are queued up in a look-ahead buffer as a sequence of speech frames. Each speech frame is then classified into one of four predefined classes: voiced frame, unvoiced frame, silence frame, and transition frame. Each class is associated with an expected coding rate. Voiced and transition frames are more complex and are thus associated with relatively high expected coding rates, while silence and unvoiced frames are associated with low expected coding rates.

In determining a target coding rate for a current coding frame, the class distribution over all classified frames in the look-ahead buffer is studied, the current status of the bit-stream buffer is observed and an expected status of the bit-stream buffer after coding all classified frames in the look-ahead buffer at their respective expected coding rates is estimated. Thus the determined target coding rates effectively avoid overflow and underflow of the bit-stream buffer. Given the determined target coding rate, a coding rate is selected from the available rates of the coding system to approximate the target coding rate.

In a second example, a sequence of music signals is received by the multimode encoder. Similar procedures to those for estimating a target coding rate for speech signals are employed herein for music signals. For example, a music signal can be classified as transient music, stationery music, etc. However, the coding of music signals differs from the coding of speech signals in that, for music coding, the available coding rates of the multimode encoder vary continuously. Therefore, the target coding rate, rather than some approximation, is selected for coding a current music frame.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION OF THE INVENTION

Figure 1:
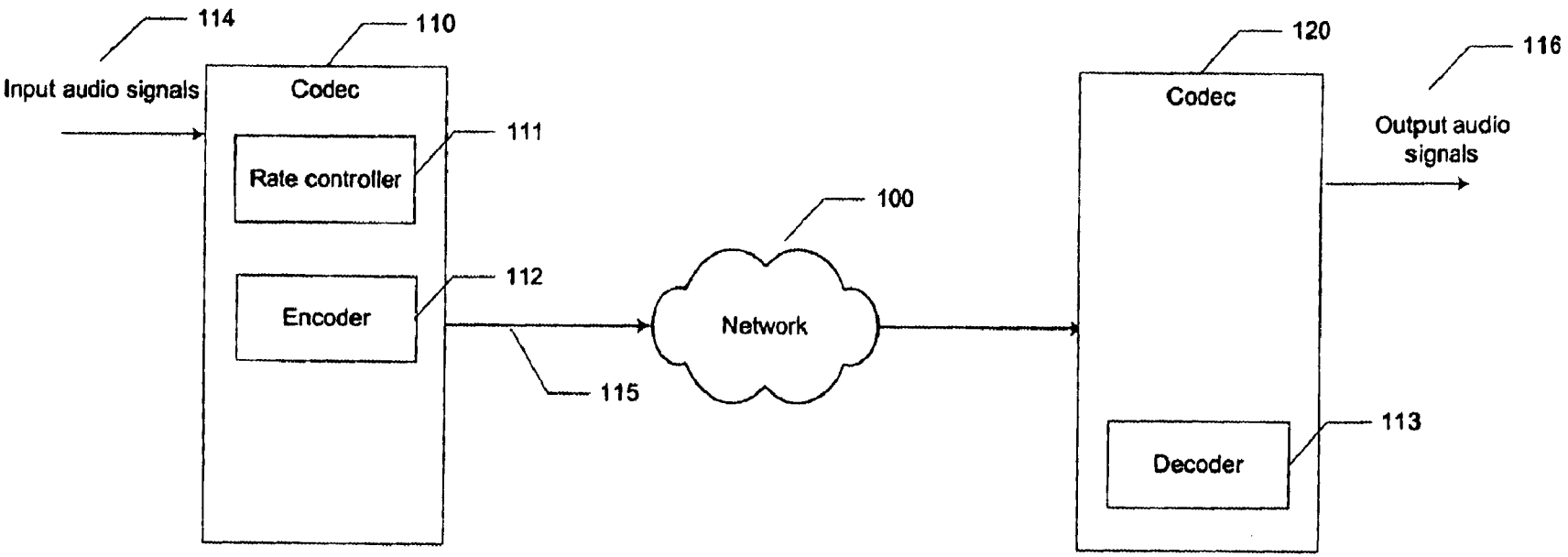
FIG. 1 is a schematic diagram illustrating exemplary network-linked hybrid speech/music coding systems wherein embodiments of the invention may be employed.

The present invention provides a method and a system for use in a multimode coding system receiving a sequence of audio frames for controlling the coding mode of the system for a current audio frame in the sequence according to the characteristics of the current audio frame, the statistical characteristics of the sequence of audio frames, and the status of a bit-stream buffer provided for buffering the encoded bit-streams generated from the audio frames.

Before describing embodiments of the invention in detail, it will be helpful to note the following concepts and definitions:

Frame: a frame is a collection of signal samples. The size of a frame is predefined. Without any loss of generality, the invention will be described assuming a frame size of 20 milliseconds. Any other suitable frame size may alternatively be used.

Sub-frame: a sub-frame is a portion of a frame.

Frame block: a frame block comprises a predefined number of frames.

Packet: a packet is a collection of a number of coded bits from the bit-stream buffer 240, wherein the number of bits in a packet is determined by a required average bit rate, the number of frames in a block, and the number of samples in a frame.

Class distribution: class distribution refers to the number of frames of each class in the look-ahead buffer.

Residue bits $C_2$: residue bits refers to the number of bits in the current bit-stream buffer 240.

Required average coding rate $R_{ave}$: required average coding rate is defined with respect to the configuration of the coding system and the environment the system is operated in;

Required average coding bits per frame $B_{ave}^{frame}$: required average coding bits per frame is the average number of bits corresponding to the required average coding rate.

Expected coding rate $R_i$: expected coding rate is a rate at which the encoder is expected to code a frame of a particular class.

Expected coding bits $B_i$: expected coding bits is the expected number of bits for encoding a frame of a particular class at an expected coding rate.

Ideal residue Bits $B_{ideal}$: ideal residue bits is defined as Q+1 packets of bits in the bit-stream buffer, wherein Q is defined in such a way that the total length of the bit-stream buffer is 2Q+1 packets. The current running average bit rate is exactly the same as the required average coding rate, if the number of bits in the bit-stream buffer equals ideal residue bits after encoding the current block.

Target differential bits $D_T$: target differential bits measures the averaged difference per frame between the expected residue bits and the ideal residue bits, wherein the average is taken over the number of frames in the look-ahead buffer 210.

Target coding rate $R_{target}$: target coding rate refers to the adjusted expected coding rate.

Target coding bits $B_{target}$: target coding bits refers to the adjusted expected coding bits.

Underflow bit limit $B_{min}$: underflow bit limit is defined as one packet of bits in the bit-stream buffer.

Overflow bit limit $B_{max}$: overflow bit limit is defined as the length in bits of the bit-stream buffer.

Minimum differential $D_{min}$: minimum differential is the averaged difference per frame between the expected residue bits and an adjusted underflow bit limit in the bit-stream buffer.

Maximum differential $D_{max}$: maximum differential is the averaged difference per frame between the expected residue bits and an adjusted overflow bit limit in the bit-stream buffer.

An exemplary multimode speech and music codec configuration in which an embodiment of the invention may be implemented is described with reference to FIG. 1. The illustrated environment comprises codecs 110, and 120 communicating with one another over a network 100, represented by a cloud. Network 100 may include many well-known components, such as routers, gateways, hubs, etc. and may provide communications via either or both of wired and wireless media. Codec 110 comprises at least a rate controller 111 and an encoder 112, while codec 120 comprises at least a decoder 113. Codec 110 receives as input an audio signal 114 and provides as output a coded audio signal 115. Codec 120 receives the coded audio signal 115 as input and provides as output a reconstructed signal 116 that closely approximates the original input signal 114.

Encoder 112 operates in multiple modes, including, but not limited to, a music mode for coding music signals and a speech mode for coding speech signals. Typical speech coding modes employ model-based techniques, such as Code Excited Linear Prediction (CELP) and Sinusoidal Coding, while typical music coding modes are based on transform coding techniques such as Modified Lapped Transformation (MLT) used together with perceptual noise masking.

Within each mode, encoder 112 further encodes signals at different coding rates. For example, in an embodiment, encoder 112 selects a coding rate from a set of discrete available coding rates for coding a speech signal. Encoder 112 preferably supports a continuously variable coding rate for coding music signals. The coding mode of the encoder is controlled by the rate controller 111, which will be discussed with reference to FIG. 2.

Figure 2:
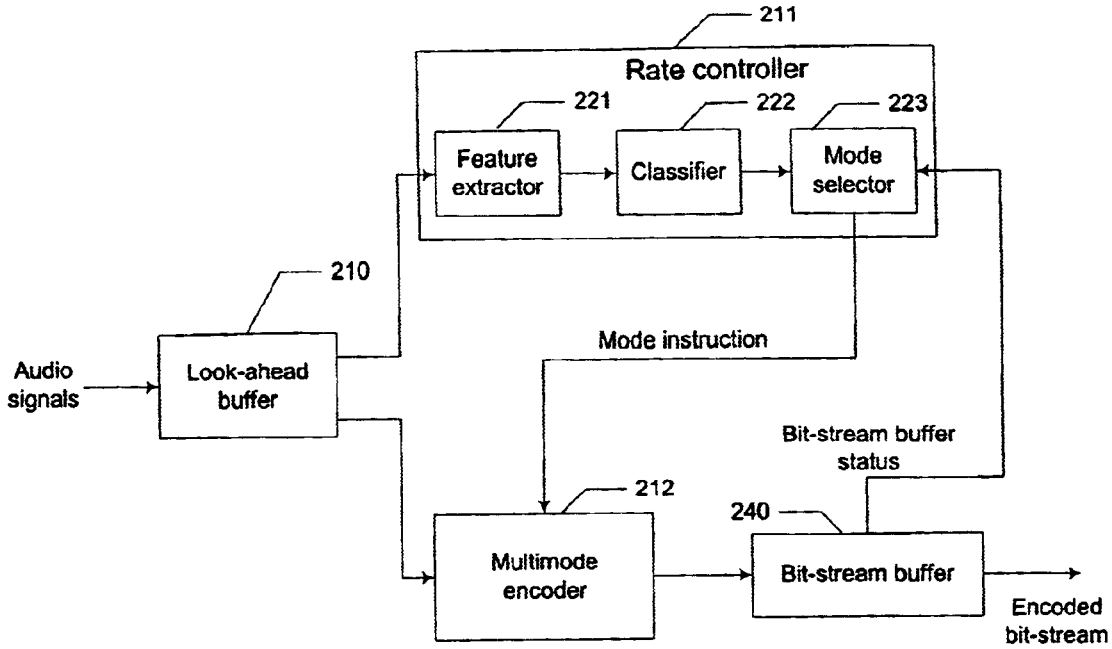
FIG. 2 is a simplified block diagram illustrating the functional modules according to an embodiment of the invention.

Referring to FIG. 2, input audio signals are recorded sequentially in a look-ahead buffer 210 as a sequence of audio frames, each of which consists of a plurality of samples. The frames sequentially flow into multimode encoder 212 wherein the frames are encoded into bit-streams. The bit-streams are then stored in bit-stream buffer 241. Multimode encoder 212 operates in various modes under the control of rate controller 211. For a current coding frame, rate controller 211 first estimates an expected coding rate for the current frame based on the properties of the current frame. As will be described in greater detail hereinafter, the rate controller then adjusts the expected coding rate by an amount that is calculated according to (1) the properties of all frames in look-ahead buffer 210, (2) the status of bit-stream buffer 240, (3) overflow and underflow constraints of bit-stream buffer 240, and (4) the available coding modes of the coding system.

The adjusted expected coding rate is sent to multimode encoder 212 as the coding rate to be used in coding the current frame. After encoding the current frame, these processes are repeated for subsequent frames. According to an embodiment of the invention, the encoder continuously encodes a frame block, each frame block comprising a series of frames. The multimode encoder 212 sends the coded bits of each frame to bit-stream buffer 240. After encoding all frames in a block, bit-stream buffer 240 outputs a packet of bits, each packet comprising a plurality of coded bits.

At the beginning of a coding procedure, the summation of the number of residue bits and the transmitted coded bits from the encoder in bit-stream buffer 240 may be less than the number of bits required to fill a packet. This results in a condition termed underflow of the bit-stream buffer, and causes inefficient utilization of network resources, or other transmission or storage resources. To avoid such underflow, a pre-buffering technique is preferably employed. Thus, for a few blocks (Q blocks in an embodiment of the invention) at the beginning of a coding procedure, the bit-stream buffer 240 will just continuously buffer coded bits transmitted from the encoder 212 without sending out coded bits.

A flow chart showing the steps executed for performing the method described above is illustrated in FIG. 3. Starting at step 310, features of the audio signals stored in look-ahead buffer 210 are extracted for each frame. For efficiently and accurately classifying speech and music signals, the features utilized are selected based on the generalized characteristics of the disparate signal types. Optimally, such a feature essentially characterizes a type of signal, i.e., it presents distinct values for different signal types. The features may be any features that allow distinction of data types, but are selected in an embodiment from the following or the variance thereof: spectral flux, zero crossing, spectral centroid, and energy contrast. Whether the selected features indicate a speech signal or a music signal, the signal may be further classified according to its intrinsic characteristics. For example, a classified speech signal is further classified as a voiced signal, unvoiced signal, silence signal, or a transition signal.

At step 320, the extracted features are analyzed in order to classify the associated frame as speech or music. At step 330, the status of the bit-stream buffer is observed and the number of residue bits in the current bit-stream buffer is obtained. Given the class information of the current frame and of all frames in the look-ahead buffer, and the status of the current bit-stream buffer, a coding rate to be used by the multimode encoder for coding the current frame is determined at step 340.

In the following, detailed exemplary embodiments of the invention are discussed with reference to FIG. 4 through 6. In an embodiment of the invention, the coding rate at which the encoder codes a frame is determined based on a target coding rate $R_{target}$. The target coding rate is estimated based on an expected coding rate $R_i$ and an amount of adjustment $D_T$ of the expected coding rate under the overflow and underflow constraints, which are represented by $D_{min}$, and $D_{max}$, respectively. The expected coding rate $R_i$ is determined according to a required average coding rate $R_{ave}$ and the class of the current frame. The estimation of the amount of adjustment $D_t$ involves an analysis of all frames in the look-ahead buffer, the current status of the bit-stream buffer, and the expected status of the bit-stream buffer after encoding all frames in the look-ahead buffer.

Figure 4:
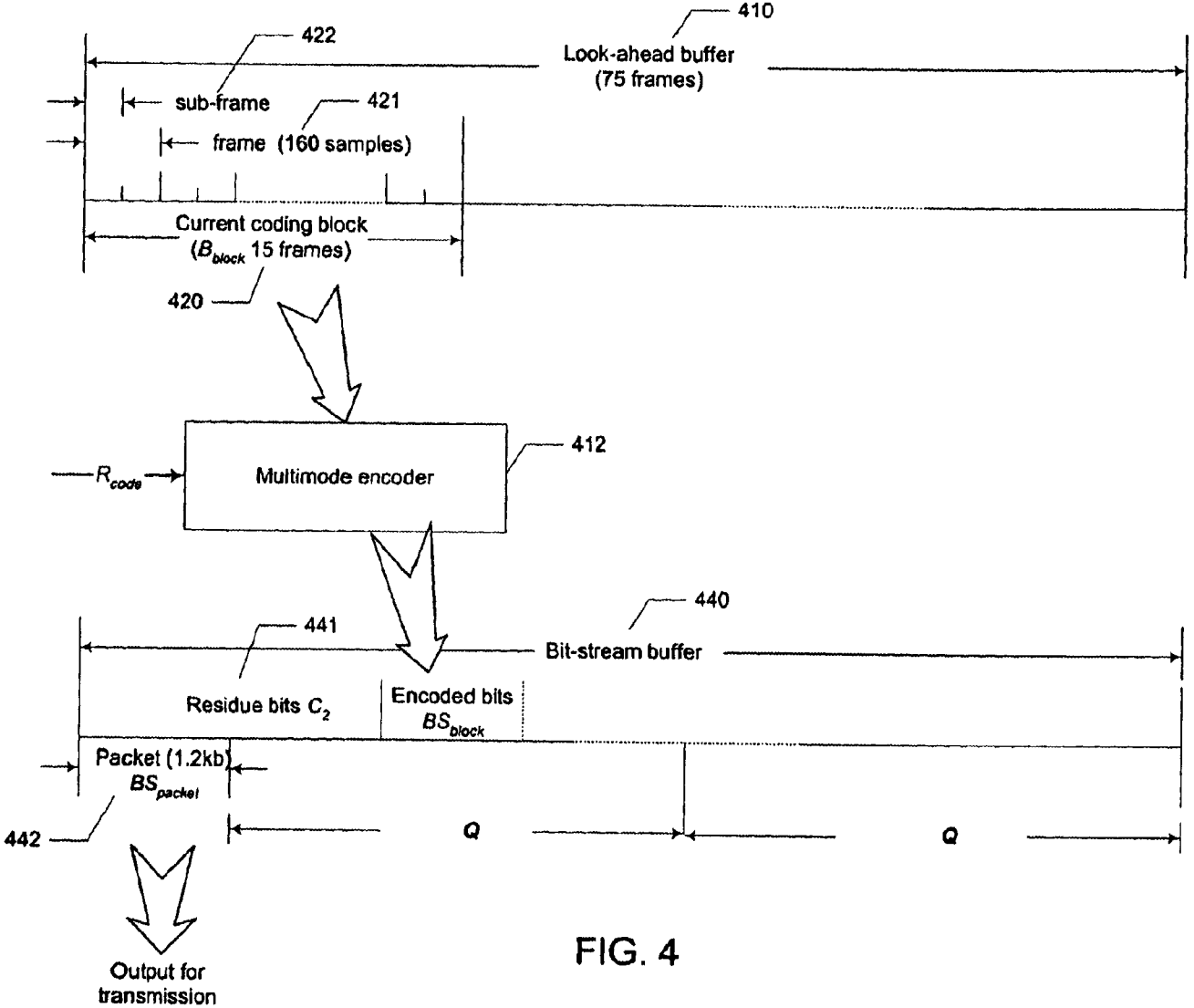
FIG. 4 is a diagram illustrating an exemplary structure of a look-ahead buffer and a bit-stream buffer according to an embodiment of the invention and the data flow between the look-ahead buffer, the bit-stream buffer and the multimode encoder.

Referring to FIG. 4, in an embodiment of the invention, the coding system receives a sequence of sampled speech signals taken at a sampling rate such as 8 kHz (8000 samples per second). The sequence of signals is then queued up in look-ahead buffer 410 as a sequence of speech frames, each of which comprises a number of speech samples. The size of a frame may be predefined, such as by a user or system programmer or administrator. Within this embodiment, a typical frame 421 is set to 20 milliseconds (hereafter, "ms"), corresponding to 160 samples. A frame is then further subdivided into sub-frames 422, and a set of consecutive frames are further grouped into a frame block 420 with a typical size of 15 frames.

Each frame in a block is encoded by multimode encoder 412, wherein separate frames may be encoded at different coding rates that are controlled by a rate controller such as rate controller 211 in FIG. 2. The encoder may send encoded bits to the bit-stream buffer 440 after encoding each frame, or may encode several frames together and then transmit corresponding encoded bits to the bit-stream buffer. After encoding a frame or block of frames and transmitting the corresponding coded bits, the multimode encoder 412 begins to encode the next frame or block of frames, and a new frame or block of incoming frames is queued up in look-ahead buffer 410. The coded bits transmitted from multimode encoder 412 are buffered in bit-stream buffer 440 along with the residue bits 441. Upon finishing the encoding of a current frame or block, bit-stream buffer subsequently sends a packet of coded bits out to the transmission or storage medium.

The following example demonstrates a method of calculating the number of bits in a packet according to an embodiment of the invention. Given a sampling rate of 8 kHz, and a required average coding rate $R_{ave}$ of 6 kbits-per-second (hereafter, "kbps"), and assuming that each frame block has 15 frames, each of which has 160 samples, a packet has 1200 bits (1800 bits=6000 bps×(15 frames-per-block×160 samples-per-frame/8000 samples-per-second)).

Referring again to FIG. 1, multimode encoder 112 is controlled by the rate controller 111, which determines a coding rate for encoder 112 to be used for coding the current frame based on the target coding rate. For measuring the suitability of the determined target coding rate for the current frame, an ideal coding rate is set corresponding to an ideal coding process predefined, and compared with the determined target coding rate.

With the total length of the bit-stream buffer being 2Q+1 packets, as shown in FIG. 4, the ideal length of residue bits 241 is Q+1 packets after loading the encoded current coding block. To achieve this target at the beginning of coding when there are no encoded bits in the bit-stream buffer 440, the encoded bit-streams are preferably not output for transmission until the encoded bits of the first Q blocks are pre-buffered in the bit-stream buffer 440. During the rest of the coding process, the determined optimal coding process is used in determining the target coding rate, which will be discussed with reference to FIG. 5 and 6.

Figure 3:
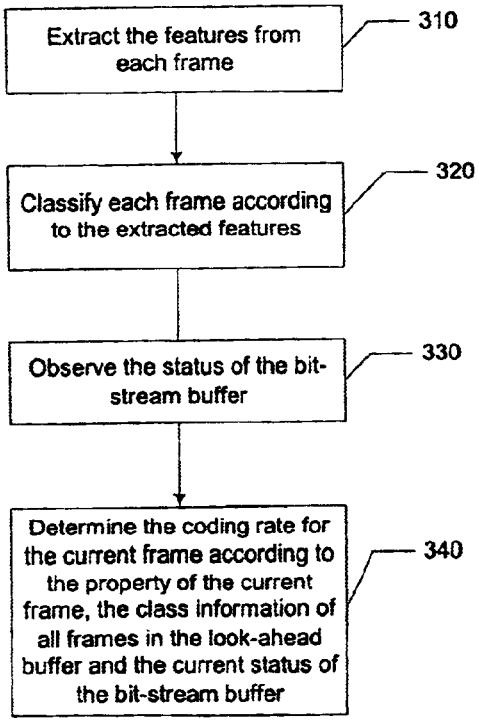
FIG. 3 is a flow chart showing the steps executed in determining a coding rate for a current coding frame.
Figure 5:
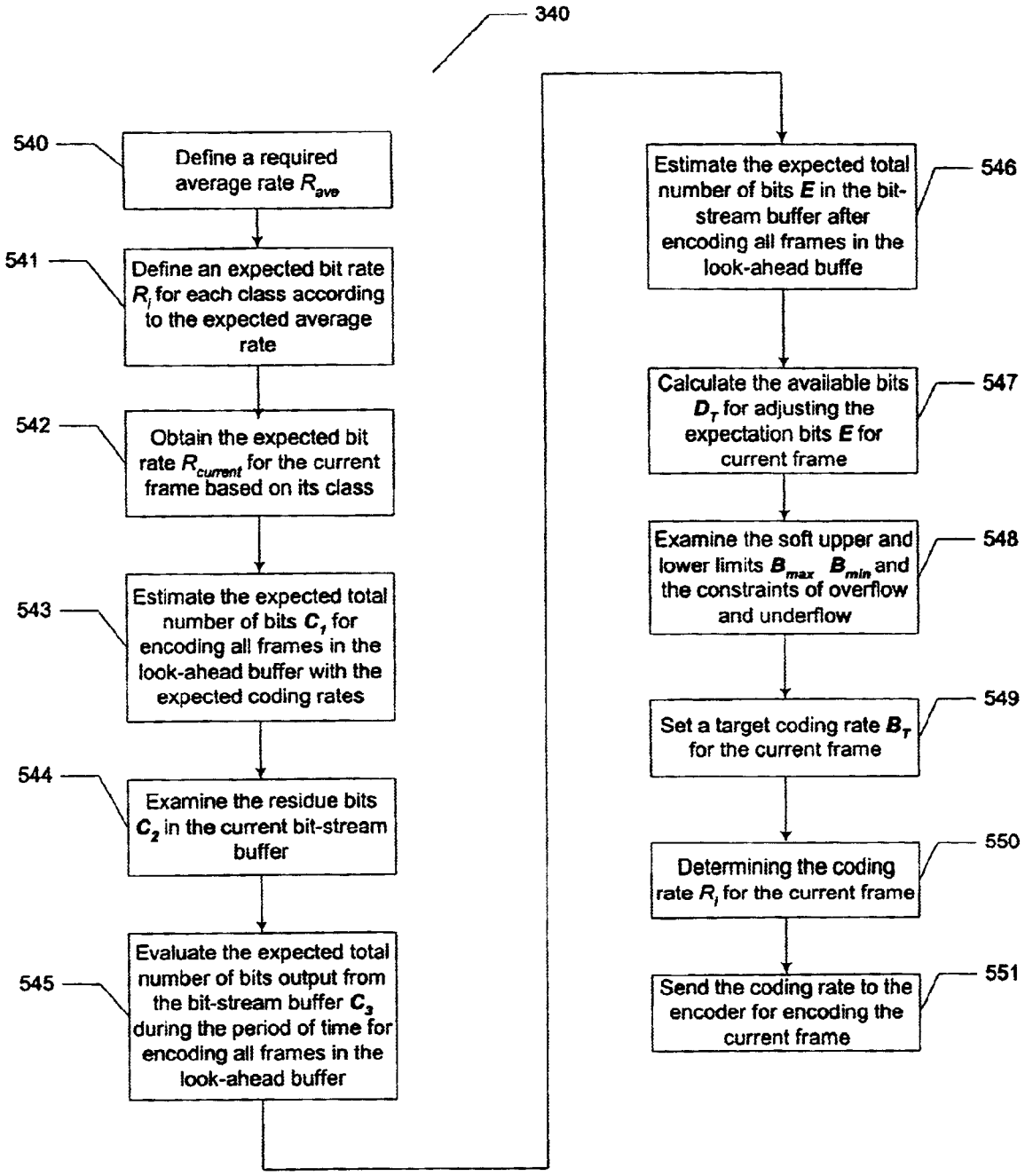
FIG. 5 is a flow chart presenting steps executed in determining a target coding rate and an actual coding rate for a current coding frame.

Referring to FIG. 5, a flow chart is presented to explain in greater detail the steps executed in determining a target coding rate for the current frame as specified at step 340 in FIG. 3. The process of determining a target coding rate begins at step 540 wherein a required average coding rate $R_{ave}$ is defined with respect to the configuration of the coding system and operation environment of the system. For example, the transmission medium may limit transmissions to 6 kbps.

Given the required average coding rate, each predefined speech class is associated with an expected coding rate at step 541. For example, given a required average coding rate of 6 kbps, a sampling rate of 8 kHz, and a 20 ms signal frame, the voice frame, unvoiced frame, silence frame and transition frame are associated with expected coding rates of 8.5 kbps, 2.3 kbps, 1.3 kbps, and 10 kbps respectively. And accordingly, the expected bits per frame are 170 bits, 46 bits, 26 bits, and 200 bits for each voiced frame, unvoiced frame, silence frame, and transition frame, respectively. Although step 541 is shown in sequence for the sake of logical explanation, it will be appreciated that the association between expected bit rates and classes for a given expected average rate may be, and often will be, made earlier.

Following step 541, the expected coding rate for the current speech frame is obtained at step 542. Steps 543 to 548 are then executed to estimate a target coding rate based on the expected coding rate for the current frame. At step 543, the expected total number of coded bits $C_1$ for coding all frames in the look-ahead buffer is estimated. For the sake of explanation, it is assumed that at this stage of the process there are $N_v$ voice frames, $N_{uv}$ unvoiced frames, $N_t$ transition frames, and $N_s$ silence frames and the expected coding bits for voice frames, unvoiced frames, transition frames, and silence frames are $B_v$, $B_{uv}$, $B_{tran}$, and $B_s$, respectively. Then $C_1$ can be written as:

$$C_1=N_v\times B_v+N_{uv}\times B_{uv}+N_{tran}\times B_{tran}+N_s\times B_s \quad \text{(Equation 1).}$$

At step 544, the number of bits in the current bit-stream buffer $C_2$ is determined. At step 545, the total number of bits output from the bit-stream buffer $C_3$ during the time interval of encoding all frames in the look-ahead buffer is evaluated. For example, given the coding rate configuration, the average coding rate is the ideal coding rate represented by $B_0$. Then $C_3$ is represented by the following:

$$C_3=(N_v+N_{uv}+N_{tran}+N_s)\times B_0 \quad \text{(Equation 2).}$$

Having calculated $C_1$, $C_2$, and $C_3$, the expected number of bits E in the bit-stream buffer after encoding all frames in the current look-ahead buffer is estimated at step 546. The quantity E is represented by the following:

$$E=C_1+C_2-C_3 \quad \text{(Equation 3).}$$

In general, E is not precisely equal to the ideal value $(Q+1)\times B_0$, because the number of bits used for encoding each frame varies from frame to frame. The difference between actual and ideal values of E is used to adjust the number of bits used for coding the current frame. According to an embodiment of the invention, the difference is not assigned exclusively to the current frame, but is instead distributed substantially uniformly in all frames in the look-ahead buffer. Therefore, the actual number of bits $D_t$ available for adjusting the bits used for coding the current frames is calculated at step 547 according to the following:

$$D_T=[(Q+1)\times B_0-E]/K \quad \text{(Equation 4).}$$

wherein K is the total number of frames in the look-ahead buffer. Alternatively, frames such as silence frames and unvoiced frames may be excluded from K because adjusting their coding rates would not substantially enhance the final signal coding quality. With $D_t$, the target bit rate for the current frame may be obtained according to the following:

$$B_T=E+D_t \quad \text{(Equation 5).}$$

In addition to estimating the target rate for the current coding frame, it is preferably also ensured that the estimated target rate lies in a reasonable range such that overflow and underflow of the bit-stream buffer are avoided. This check is performed at step 548, wherein overflow and underflow limits are represented by $B_{max}$ and $B_{min}$ respectively, and are expressed as follows:

$$B_{min}=(\alpha\times 2Q+1)\times B_0$$

$$B_{max}=(\beta\times 2Q+1)\times B_0 \quad \text{(Equation 6).}$$

wherein α and β are parameters for softening the limitations, thus providing extra bits for protecting the limits. For those frames not at the edges of the coding block, typical values for α and Δ are 0.2 and 0.8, respectively.

In addition to checking for overflow and underflow at the end of the look-ahead buffer, overflow and underflow at the end of a current block should also be avoided. For example, it may be that many frames in a current coding block are voice and/or transition frames that require relatively high bit rates, while in the following coding blocks, a majority of the frames are unvoiced and/or silence frames that tolerate much lower bit rates. In this example, buffer overflow may occur after coding the current block, though overflow may not happen at the end of the look-ahead buffer. Similarly, if a majority of the frames in the current coding block are unvoiced and/or silence frames and in the following coding bocks, most of the frames are voiced frames and/or transition frames, buffer underflow may occur after encoding the current block.

To avoid these adverse effects, the expected number of bits at the edges of current block E' are also estimated and restricted by $B'_{min}$ and $B'_{max}$ which are derived according to Equation 6. The values of $\alpha$ and $\beta$ for edge frames are preferably much smaller and much larger respectively than $\alpha$ and $\beta$ for non-edge frames. Thus, typical values of $\alpha$ and $\beta$ used to derive $B'_{min}$ in and $B'_{max}$ are 0.002 and 0.99.

With the estimated rate limits, $B_{min}$ and $B_{max}$ the minimum ($D_{min}$) and maximum ($D_{max}$) number of bits available for adjusting the bit rate for the current frame are obtained as:

$$D_{min}=[B_{min}-E]/K$$

$$D_{max}=[B_{max}-E]/K \qquad \text{(Equation 7).}$$

$D_{min}$ and $D_{max}$ may be adjusted further to avoid underflow or overflow. In particular, Equation 7 yields $D'_{min}$ and $D'_{max}$ for $B'_{min}$, $B'_{max}$ and E'. If $D'_{min}$ is larger than $D_{min}$, then $D_{min}$ is replaced by $D'_{min}$. Therefore, for the current coding frame in the current coding block, the range for the target bit rate is:

$$E+D_{min}<B_T<E+D_{max} \qquad \text{(Equation 8).}$$

If the estimated target coding rate satisfies overflow and underflow requirements at step 548, the estimated target coding rate is assigned to the current coding frame at step 549.

Since the speech coding mode has discrete rather than continuous available coding rates, the target coding rate often will not correspond precisely to one of the available rates. In this case, an available rate most closely approximating the target coding rate is selected as the actual coding rate for the current coding frame at step 550. At step 551, the coding rate is sent to the encoder.

Figure 6:
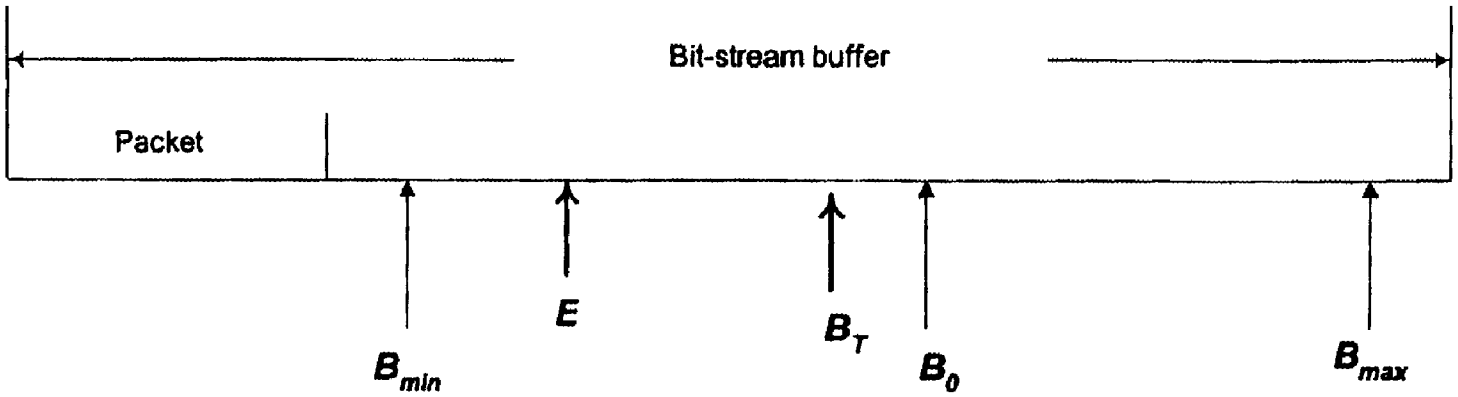
FIG. 6 is a data storage representation depicting the relative positions within a bit-stream buffer of minimum and maximum coding bits, the expected coding bits, the target coding bits and the ideal coding bits for a current coding frame.

FIG. 6 illustrates the relative positions of the parameters in the bit-stream buffer. As shown, $B_{min}$ and $B_{max}$ set the range of the bit-rate for the current frame. The value $B_0$ indicates the ideal bit-rate for the current frame, while $B_T$ presents the target bit-rate for the current frame, and E is the estimated expectation rate for the current frame in the current coding block.

The frames in the look-ahead buffer are coded sequentially on a frame-by-frame basis. After encoding a current block, a corresponding packet of bits is sent out from the bit-stream buffer. In network applications, such as those involving multimedia presentation via a network, the packets of bits are transmitted via the network as a bit-stream to remote devices. The methods of transmitting information over various network types using a myriad of protocols are well known, and will not be presented in detail herein.

To enable the receiving device to successfully convert the bit-stream back into audio information, the transmitted bit-stream carries coding information associated with each frame. Such information, for example, identifies each frame by type to enable decoding via a multimode codec or decoder. Other information will sometimes be required as well, such as information regarding the coding technique used by the coder. Upon receiving the transmitted bit-stream from the network, the decoder dismantles the packets and processes the coded frame information according to the carried coding information, and finally constructs a replica of the original input audio signals.

Figure 7:
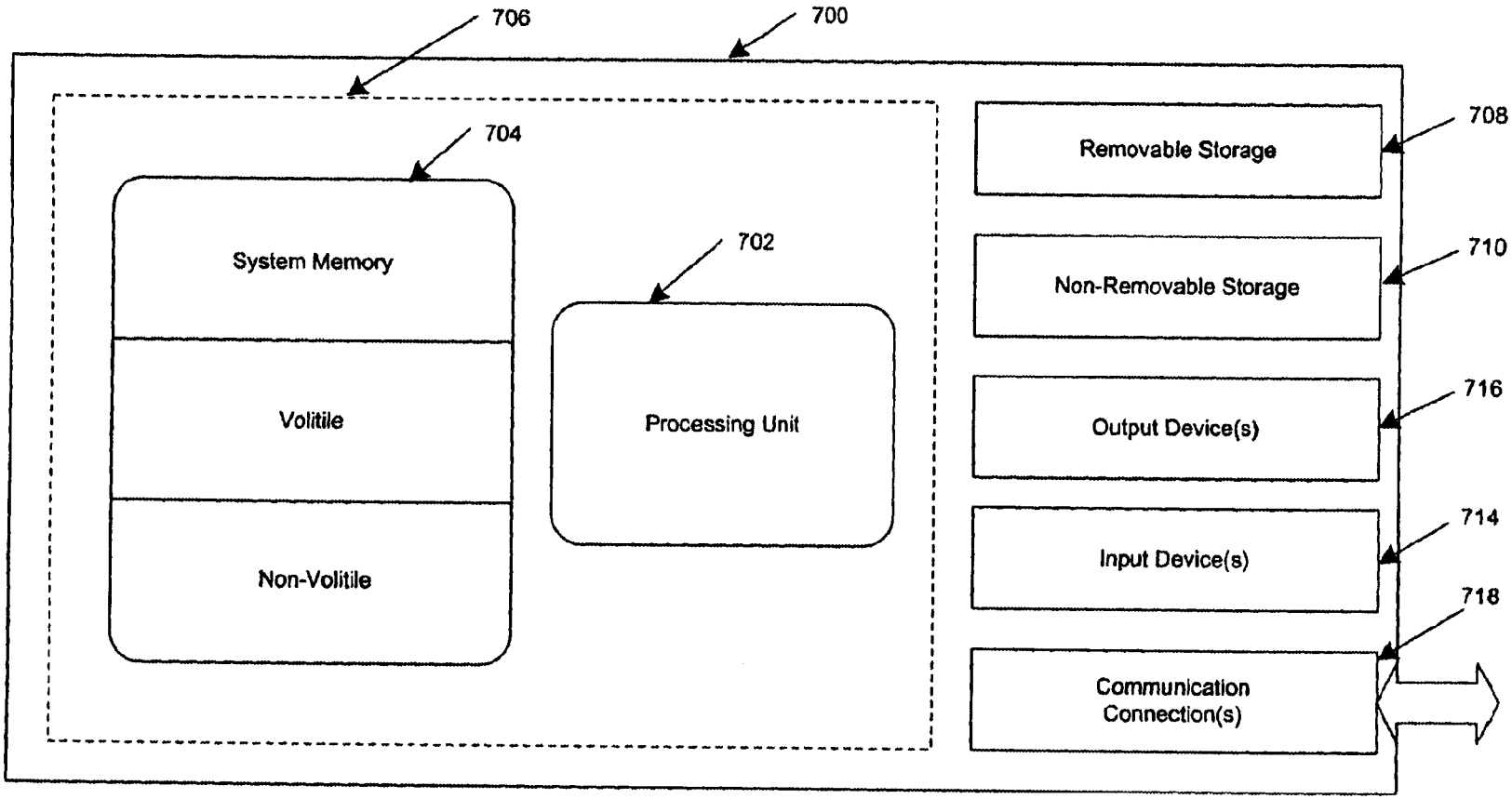
FIG. 7 is a simplified schematic illustrating a computing device architecture employed by a computing device upon which an embodiment of the invention may be executed.

With reference to FIG. 7, one exemplary computing system for implementing embodiments of the invention includes a computing device, such as computing device 700. Although such devices are well known to those of skill in the art, a brief explanation will be provided herein for the convenience of other readers. In its most basic configuration, computing device 700 typically includes at least one processing unit 702 and memory 704. Depending on the exact configuration and type of computing device, memory 704 can be volatile (such as RAM), non-volatile (such as ROM, flash memory, etc.) or some combination of the two. This most basic configuration is illustrated in Fig.7 by dashed line 706.

Additionally, device 700 may also have other features and/or functionality. For example, device 700 could also include additional removable and/or non-removable storage including, but not limited to, magnetic or optical disks or tape, as well as writable electrical storage media. Such additional storage is illustrated in FIG. 7 by removable storage 708 and non-removable storage 710. Computer storage media includes volatile and nonvolatile, removable and non-removable media implemented in any method or technology for storage of information such as computer readable instructions, data structures, program modules or other data. Memory 704, removable storage 708 and non-removable storage 710 are all examples of computer storage media. Computer storage media includes, but is not limited to, RAM, ROM, EEPROM, flash memory or other memory technology, CDROM, digital versatile disks (DVD) or other optical storage, magnetic cassettes, magnetic tape, magnetic disk storage or other magnetic storage devices, or any other medium which can be used to store the desired information and which can accessed by device 700. Any such computer storage media may be part of, or used in conjunction with, device 700.

Device 700 may also contain one or more communications connections 718 that allow the device to communicate with other devices. Communications connections 718 carry information in a communication media. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. As discussed above, the term computer readable media as used herein includes both storage media and communication media.

Device 700 may also have an audio input device 714 as well as possibly one or more other input devices 714 such as keyboard, mouse, pen, touch input device, etc. One or more output devices 716 such as a display, speakers, printer, etc. may also be included. All these devices are well known in the art and need not be discussed at greater length here.

It will be appreciated by those of skill in the art that a new and useful method and system of performing audio processing and encoding have been described herein. In view of the many possible embodiments to which the principles of this invention may be applied, however, it should be recognized that the embodiments described herein with respect to the drawing figures are meant to be illustrative only and should not be taken as limiting the scope of invention. For example, those of skill in the art will recognize that the illustrated embodiments can be modified in arrangement and detail without departing from the spirit of the invention. Although the invention is described in terms of software modules or components, those skilled in the art will recognize that such may be equivalently replaced by hardware components. Therefore, the invention as described herein contemplates all such embodiments as may come within the scope of the following claims and equivalents thereof.

What is claimed is:

1. A method for controlling the coding rate of a multimode coding system for coding a current audio signal frame in a sequence of audio signal frames, the method comprising the steps of:

determining a signal type corresponding to the audio signal of each frame in the sequence of frames;

determining an expected coding rate for the current frame according to the signal type of the audio signal of the current frame and an established average coding rate for the sequence of frames;

estimating a target coding rate for the current frame by adjusting the expected coding rate wherein the adjustment to the expected coding rate is based on the signal type of at least one other frame in the sequence of frames and the status of a bit-stream buffer maintained for buffering coded frames; and determining a coding rate for use in coding the current frame according to the target coding rate.

2. The method of claim 1, wherein the step of determining a signal type corresponding to the audio signal of each frame in the sequence of frames further comprises the step for each frame of mapping the frame to one signal type in a set of signal types, wherein each signal type corresponds to a set of available coding rates associated with a range of possible average coding rates.

3. The method according to claim 2, wherein the set of signal types is a discrete set of signal types including a speech voiced type, a speech unvoiced type, a speech silence type, and a speech transition type.

4. The method according to claim 2, wherein the set of signal types includes a music signal type.

5. The method of claim 1, wherein the step of estimating a target coding rate for the current frame by adjusting the expected coding rate further comprises the steps of:

calculating an expected total number of bits to be used for coding all frames in the sequence according to the class distribution over all frames in the sequence and an expected coding rate assigned to each class;

observing the total number of residue bits in the current bit-stream buffer;

estimating an expected total number of bits that will have been sent out from the bit-stream buffer during coding all frames in the sequence;

obtaining an expected total number of residue bits in the bit-stream buffer after coding all frames in the sequence according to the expected total number of bits, total number of residue bits in the current bit-stream buffer, and expected total number of bits that will have been sent out from the bit-stream buffer;

obtaining a total number of available bits for adjusting the expected coding rate for the current frame by comparing the obtained total number of residue bits in the bit-stream buffer with a predefined total ideal number of residue bits in the bit-stream buffer after coding all frames in the sequence; and adjusting the expected coding rate for the current frame in accordance with the total number of available bits for adjusting.

6. The method of claim 5, further comprising the step of comparing the total number of available bits deducted to a first adjustment limit and a second adjustment limit for avoiding an underflow and overflow of the bit-stream buffer respectively.

7. The method of claim 1, wherein the step of estimating a target coding rate for the current frame by adjusting the expected coding rate further comprises the step of comparing the total number of available bits for adjusting to a first adjustment limit and a second adjustment limit for avoiding an underflow or overflow of the bit-stream buffer respectively.

8. The method of claim 1, wherein the step of determining a coding rate for use in coding the current frame according to the target coding rate further comprises the steps of:

determining whether the determined signal type is associated with a coding rate corresponding to the target coding rate; and if the determined signal type is not associated with a coding rate corresponding to the target coding rate, selecting a coding rate associated with the determined signal type, wherein the selected coding rate most closely approximates the target coding rate.

9. The method of claim 8 further comprising the step of selecting a coding rate associated with the determined signal type, wherein the selected coding rate corresponds to the target coding rate, if the determined signal type is associated with a coding rate corresponding to the target coding rate.

10. The method of claim 1 further comprising the steps of:

coding the current frame according to the determined coding rate;

buffering coded bits corresponding to the current frame in the bit-stream buffer;

determining whether the number of frames corresponding to the encoded bits buffered in the bit-stream buffer exceeds a predefined pre-buffering number of encoding frames; and if the number of frames exceeds the pre-buffering number, starting to output a packet of bits from the bit-stream buffer.

11. The method of claim 10 further comprising the step of holding the bits in the bit-stream buffer without outputting a packet if the total number of encoding frames does not exceed the pre-buffering number.

12. A computer-readable medium having computer executable instructions for performing the method of claim 1.

13. A coding system for coding a sequence of audio frames corresponding to a digitized sampled input audio signal to generate a series of coded bits, the system comprising:

a look-ahead buffer for queuing the sequence of frames;

a multimode encoder for receiving frames corresponding to the frames in the look-ahead buffer and encoding the frames into coded bits;

a bit-stream buffer for storing the coded bits generated from the encoder and emitting coded bits; and a rate controller in connection with the look-ahead buffer and the multimode encoder for controlling the coding mode and coding rate of the multimode encoder, while encoding each frame, according to a characteristic of a current frame, a classification of each other frame in the sequence, and the status of the bit-stream buffer.

14. The system according to claim 13, wherein the emitted coded bits are adapted for use by a multimode decoder in decoding the emitted coded bits to reproduce a replica of the input audio signal.

15. The system according to claim 13, wherein the rate controller further comprises:

a feature extractor for extracting a set of at least one predefined feature from the signal contained in each frame, wherein the at least one feature is usable to characterize a signal in a frame;

a classifier in connection with the feature extractor for classifying each frame according to the at least one extracted feature from that frame; and a mode selector in connection with the classifier for selecting a proper coding mode for the encoder for each frame based on the classification of the frame, the classification of at least one other frame in the look-ahead buffer, and the status of the bit-stream buffer.

16. The system according to claim 15, wherein the classifier is adapted to classify each frame as one of a music frame, a speech voiced frame, a speech unvoiced frame, a speech silence frame, and a speech transition frame.

17. A method for controlling the coding rate for each frame in a sequence of speech data frames in a multimode encoder, the method comprising:

classifying each frame in the sequence of frames into one of a plurality of predefined classes according to a feature of the frame data, wherein each class is associated with an expected coding rate based on a required average coding rate and the relative importance of data of the class to the perceived quality of a reproduced speech signal;

deriving an adjustment for adjusting the expected coding rate for each frame according to the class of each frame in the sequence of frames and the status of a bit-stream buffer provided for storing encoded bits corresponding to the frames;

adjusting the expected coding rate based on the derived adjustment; and determining a coding rate for encoding each frame according to the adjusted expected coding rate.

18. The method according to claim 17, wherein at least four of the predefined classes correspond to voiced frame, unvoiced frame, transition frame, and silence frame respectively.

19. A computer-readable medium having computer-executable instructions for performing the method of claim 17.

20. A method for controlling the coding rate of a multimode coding system for coding a current audio signal frame in a sequence of audio signal frames, the method comprising the steps of:

determining a signal type corresponding to the audio signal of each frame in the sequence of frames;

estimating a target coding rate for the current frame based on the signal type of at least one other frame in the sequence of frames, the status of a bit-stream buffer maintained for buffering coded frames, and an established average coding rate for the sequence of frames; and determining a coding rate for use in coding the current frame according to the target coding rate.

21. The method of claim 20, wherein the step of estimating a target coding rate for the current frame further comprises the steps of:

calculating an expected total number of bits to be used for coding all frames in the sequence according to the class distribution over all frames in the sequence and an expected coding rate assigned to each class;

observing the total number of residue bits in the current bit-stream buffer;

estimating an expected total number of bits that will have been sent out from the bit-stream buffer during the coding of all frames in the sequence;

obtaining an expected total number of residue bits in the bit-stream buffer after coding all frames in the sequence according to the expected total number of bits to be used for coding all frames, the total number of residue bits in the current bit-stream buffer, and the expected total number of bits that will have been sent out from the bit-stream buffer during coding all frames in the sequence;

obtaining a total number of available bits for adjustment by comparing the obtained total number of residue bits in the bit-stream buffer with a predefined total ideal number of residue bits in the bit-stream buffer after coding all frames in the sequence; and estimating the target coding rate for the current frame according to the signal type of the audio signals of the current frame, the established average coding rate and the total number of available bits for adjustment.

22. The method of claim 21, further comprising the step of comparing the total number of available bits for adjustment to a first adjustment limit and a second adjustment limit for avoiding an underflow or overflow of the bit-stream buffer respectively.

23. The method of claim 20, wherein the step of determining a coding rate for use in coding the current frame according to the target coding rate further comprises the steps of:

determining whether the determined signal type is associated with a coding rate corresponding to the target coding rate; and if the determined signal type is not associated with a coding rate corresponding to the target coding rate, selecting a coding rate associated with the determined signal type, wherein the selected coding rate most closely approximates the target coding rate.

24. The method of claim 23 further comprising the step of selecting a coding rate associated with the determined signal type, wherein the selected coding rate corresponds to the target coding rate, if the determined signal type is associated with a coding rate corresponding to the target coding rate.

25. A computer-readable medium having computer executable instructions for performing the method of claim 20.

* * * * *

UNITED STATES PATENT AND TRADEMARK OFFICE

CERTIFICATE OF CORRECTION

PATENT NO. : 6,647,366 B2
DATED : November 11, 2003
INVENTOR(S) : Wang et al.

It is certified that error appears in the above-identified patent and that said Letters Patent is hereby corrected as shown below:

Title page,
Item [56], References Cited, OTHER PUBLICATIONS, "Combescure, P., et al.," "kbit/s" should read -- KBIT/S --.

Column 6,
Line 36, "$D_t$" should read -- $D_T$ --.

Column 8,
Lines 22, 32 and 34, "$D_t$" should read -- $D_T$ --.
Line 50, "$\Delta$" should read -- $\beta$ --.

Signed and Sealed this

Twenty-seventh Day of July, 2004

JON W. DUDAS
*Acting Director of the United States Patent and Trademark Office*